United States Patent [19]

Andreas et al.

[11] Patent Number: 4,943,439

[45] Date of Patent: Jul. 24, 1990

[54] MICROWAVE RECEPTIVE HEATING SHEETS AND PACKAGES CONTAINING THEM

[75] Inventors: David W. Andreas, Minneapolis; David H. Cox, Robbinsdale, both of Minn.

[73] Assignee: Golden Valley Microwave Foods Inc., Edina, Minn.

[21] Appl. No.: 169,215

[22] Filed: Mar. 15, 1988

[51] Int. Cl.[5] ..... A23L 1/025; H05B 6/80; B65D 81/34

[52] U.S. Cl. ..... 426/107; 219/10.55 E; 426/11.3; 426/234

[58] Field of Search ..... 426/107, 113, 234, 243; 219/10.55 E, 10.55 F; 99/DIG. 4

[56] References Cited

U.S. PATENT DOCUMENTS

| | | | |
|---|---|---|---|
| 3,946,187 | 3/1976 | Mac Master et al. | 219/10.55 E |
| 4,121,510 | 10/1978 | Frederick | 219/10.55 E |
| 4,398,077 | 8/1983 | Freedman et al. | 217/10.55 E |
| 4,777,053 | 10/1988 | Tobelmann et al. | 426/113 |
| 4,794,005 | 12/1988 | Swiontek | 426/107 |

*Primary Examiner*—Peter Kratz

*Attorney, Agent, or Firm*—James V. Harmon

[57] ABSTRACT

A food heating package for elongated products such as french fries and fish sticks which includes partitions formed from microwave energy absorbing material adapted to crisp, toast or brown the surfaces of the food sticks. The partitions preferably enclose the food sticks on at least three sides and can be made by forming folds in a sheet of vapor-deposited semiconductive metallic coating applied to a plastic film, e.g. polyester, backing.

12 Claims, 4 Drawing Sheets

MICROWAVE RECEPTIVE HEATING SHEETS AND PACKAGES CONTAINING THEM

FIELD OF THE INVENTION

The present invention relates to microwave receptive sheet material and more particularly to laminates and packaging formed from flexible or semi-flexible sheets that are receptive to microwave energy and are useful for heating foods in a microwave oven.

BACKGROUND OF THE INVENTION

A variety of materials such as laminates have been previously proposed for heating foods with microwave energy by absorbing a portion of the microwave energy and transmitting it in the form of heat by conduction to an object such as a food product. In some cases sheet material of this kind is stiff, brittle, subject to breakage and is not adapted to use in lightweight packaging products which should be disposable and low in cost. In other cases the laminates, while interacting with the microwave energy present in an oven, do not adequately heat the food product. Still other laminates can heat only one side of the food product. So, for example, if the food product is rectangular in shape, three sides remain unheated.

In view of the deficiencies of the prior art, it is one object to provide microwave interactive sheet material which furnishes compartments to loosely enclose food and particularly food in stick form, e.g., fish sticks or french fried potatoes and the like, and to heat the food on all sides. The application of heat to all sides is highly beneficial because it has been found that when a food piece such as a french fried potato is placed in an ordinary paper carton and heated in a microwave oven, the potato becomes soggy. This occurs even if an effort is made to allow steam vent openings at the top of the package. As a result, attempts have been made to develop laminates for lining food cartons to augment the heat provided by direct microwave interaction with the food. For example, U.S. Pat. No. 4,612,431 and the Assignees' copending application Ser. No. 740,252, now U.S. Pat. No. 4,735,513, describe laminates comprising polyester to which thin, semiconductive layers of metal have been applied. These laminates are bonded to one inside wall of the package for absorbing microwave energy and then transfering the energy to the food product. Tests conducted by us show, however, that these laminates and the resulting packages are not effective in crisping, browning or toasting the surface of foods such as french fried potatoes. After heating, the products are perceived to be moist, limp and soggy. A major objective of the invention is therefore to provide a microwave interactive laminate that will crisp, toast or brown several surfaces of a stick-shaped food product such as french fried potatoes, fish sticks and the like so that after heating it is perceived to be crisp and appetizing to the consumer.

Other attempts have been made to deal with this problem. For example, U.S. Pat. Nos. 4,267,420 and 4,230,924 provide a lightweight flexible wrapper formed from a laminate composed of a flexible sheet material such as metallized plastic film supported by a paper backing that interacts with microwave energy. One major shortcoming is that the food sticks have to be individually wrapped and later unwrapped one-by-one by the customer. Another problem results from the fact that portions of the sheet material can shrivel, shrink, split and crack, particularly in areas where it is not in contact with the food.

SUMMARY OF THE INVENTION

The present invention provides microwave interactive sheets which are self-supporting and provide self-supporting chambers or compartments that partially or completely enclose a food product to be heated in a microwave oven. Specifically, each food piece is enclosed by a sheet such as a laminate on more than one side, and it is preferred that the laminated sheets enclose the food piece on all sides. For example, a finished heating package can contain self-supporting parallel walls or partitions spaced apart from one another and extending along the length of the package in parallel relationship to provide a plurality of elongated chambers between the partitions, each of which comprises a microwave interactive sheet. In one form of the invention the package includes several partitioned trays formed from microwave interactive laminated sheet material. Each tray in one case can be made from a lamination comprising metallized polyester adhesively bonded between two paper sheets or to a single paper sheet. For example, the metallized polyester sheet or a sheet containing other microwave interactive material which becomes hot in a microwave oven such as a mineral, metal oxide, salt, carbon or the like, can be bonded between a sheet of greaseproof paper and a sheet of kraft paper. This laminate is then formed into a tray having a plurality of laterally spaced apart parallel folds or flutes defining self-supporting partitions which run parallel to each other to form parallel chambers for loosely holding the food pieces so that the food pieces can be dropped into and later slid out of the chambers in an endwise direction. In a preferred form, each chamber conforms generally to the shape of the food product. In this case the food product has a rectangular cross section, thus, it has a flat bottom and parallel upstanding side walls that intersect the bottom at right angles and act as partitions.

The invention can, however, have other forms. For example, the chambers can be formed from a first set of flat parallel sheets that are positioned at right angles to a second set of parallel sheets and interlocked with the first set to define a plurality of parallel chambers. To provide heat insulation, one or more of the sheets or trays can have an insulating coating, for example a single-faced corrugated paper sheet laminated to its surface.

In a typical application, the invention includes a stack of trays on top of one another to provide a heating surface on all major sides of a food piece. The invention can be embodied in a throw-away carton adapted to be assembled on an end-loading carton machine, that is to say, a machine which forms a folding carton that can be loaded from one end and having end flaps which are closed to seal the open end of the carton. In one preferred form of the invention, a carton is provided which includes upper and lower carton portions that are telescopically related. The top portion contains the heating sheets so that after heating when the top portion of the carton is removed, the food products will remain in the bottom portion which then functions as a serving tray. Thus, when the top portion of the carton is separated from the bottom, the food pieces will fall or slip out from between the microwave interactive partitions into the lower portion which serves as a disposable dish from which the food can be directly eaten.

The invention will now be described by way of example with reference to the accompanying figures which illustrate but a few of the various ways in which the present invention can be practiced within the scope of the appended claims.

THE FIGURES

DESCRIPTION OF A PREFERRED EMBODIMENT

Figure 1:
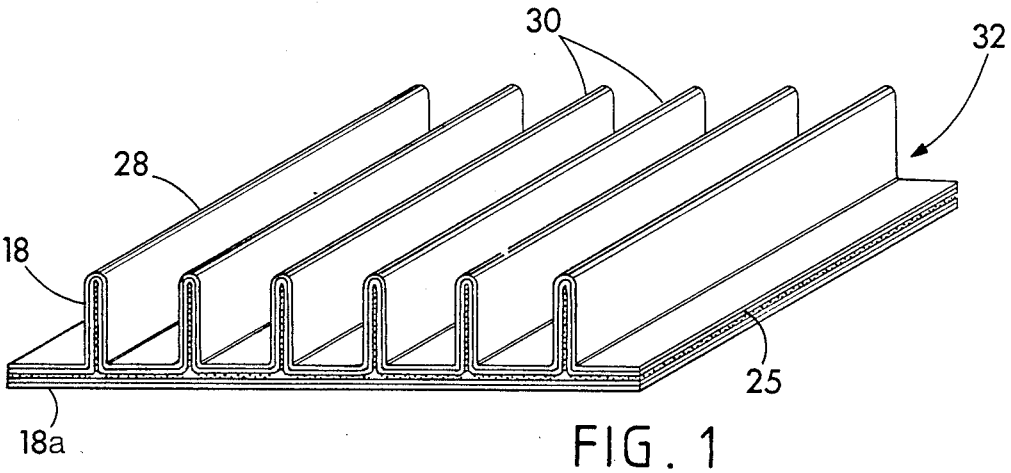
FIG. 1 is an enlarged, semi-diagrammatic perspective view showing one form of laminate in accordance with the invention.
Figure 2:
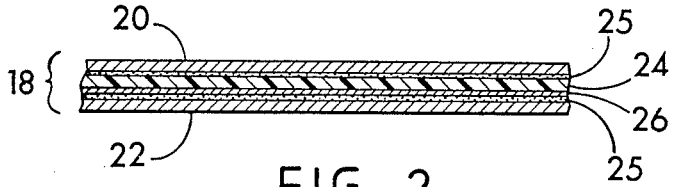
FIG. 2 is a microscopic cross-sectional view of the laminate of FIG. 1.

In FIGS. 1 and 2 is shown a sheet comprising laminate 18 in accordance with the present invention comprising three separate sheets laminated together and including an inner sheet of paper 20 facing the food, an outer sheet of paper 22 and a sheet of flexible plastic 24 such as polyester film which serves as a backing for a microwave interactive coating 26 such as a semiconductive metallic coating 26, e.g., aluminum deposited by vacuum metallization and transmitting about 40% to 60% of incident light and deposited as a coating upon a base sheet comprising a 2 mil polyester sheet 24. The metal coating 26 is semiconductive so that it will interact with the microwave energy in a microwave oven to absorb a portion of the microwave energy, converting it to heat. Other known coatings or substances that will become hot in a microwave oven can be used in place of the metal coating if desired. Layer 22 can be eliminated from sheet 18 if desired for some applications. Layer **18*a* can also be eliminated. In that event, the tray will consist of a single sheet 18 composed of a layer of paper 20, glue 25 and a microwave reactive layer (sheet 24 and coating 26**).

The laminate 18 is provided with undulations folded into a plurality of vertically extending flutes 28, the layers of which are bonded together where in contact with each other by adhesive located between them to thereby form parallel longitudinally extending self-supporting partitions 30. The upper laminate 18 is itself laminated by adhesive to a lower three-layer sheet **18*a* which has the same composition as sheet 18 but has no folds. The various sheets, e.g. flutes 28, of each of the laminates 18 or 18*a* can be bonded together with a suitable adhesive such as a polyvinylacetate emulsion type adhesive 25 (FIG. 2). The upper and lower sheets 18 and 18*a* can be bonded together by the same adhesive 25. While a variety of paper sheets can be used, sheet 20 can comprise 25-pound greaseproof paper and sheet 22 can comprise 30-pound kraft paper. The laminate 18*a* can be similarly constructed with a layer of paper on opposite sides of sheet 24, 26**.

Figure 3:
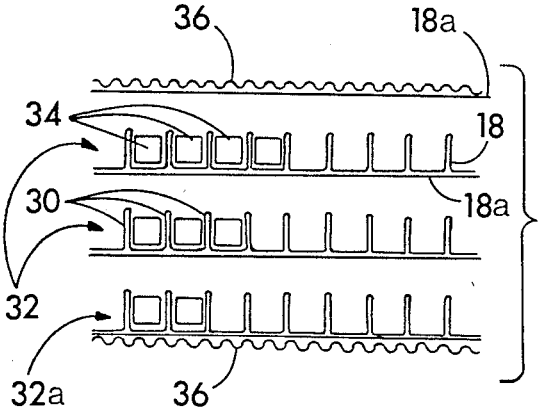
FIG. 3 is an exploded end view of a stack of laminates employed in accordance with the invention.

Refer now to FIG. 3 which illustrates a stack of laminated trays 32 formed from bonded laminates 18 and **18*a* in which are placed food pieces such as french fry sticks or fish sticks 34 in parallel relationship within the enclosures defined by the partitions 30. The bottom tray 32*a* is similar to the tray 32 except that it has a corrugated paper sheet 36 bonded to its lower surface for insulating the package by preventing loss of heat from sheet 32*a*. At the top of the stack is provided a laminated sheet 18 having a similar insulation sheet 36 bonded to its outer surface. Sheet 36 comprises a corrugated paper layer to prevent loss of heat from the microwave interactive sheet 18*a*. It will thus be seen that with the stack assembled as shown in FIG. 3 all major surfaces of the food pieces 34 are exposed to one of the microwave interactive sheets 18–18*a*** and all surfaces will thereby be browned, toasted or crisped during the heating process. This provides a perceived sense of crispness and makes the otherwise unappealing french fries or fish sticks appetizing. The invention can be used with a variety of other vegetables and meat based foods such as bread sticks, carrot sticks, soft pretzels, batter coated vegetables such as tempura, as well as corn dogs or other dough wrapped meat products.

Figure 5:
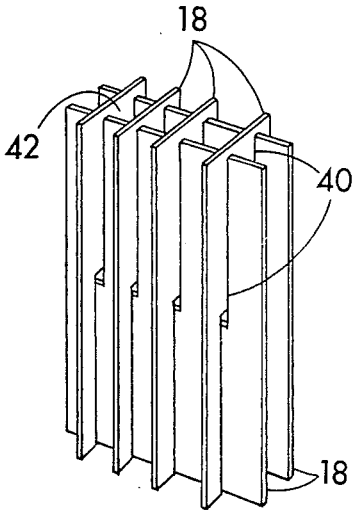
FIG. 5 is a perspective view of laminates in accordance with another form of the invention, partially separated for clarity.

Refer now to FIG. 5 which illustrates a modified form of the invention. As shown in FIG. 5 the microwave interactive sheets 18 are provided with partial longitudinally extending cuts or slits 40. In this way a first group of parallel sheets 18 are interlocked with a second group of parallel sheets 18 by sliding them together in a vertical direction as seen in FIG. 5 to provide longitudinally extending parallel elongated compartments between the mutually perpendicular sets of microwave interactive laminated sheets 18. Food products are placed in the compartments 42 between the sheets which function to crisp the food pieces during microwave heating as described above.

Figure 6:
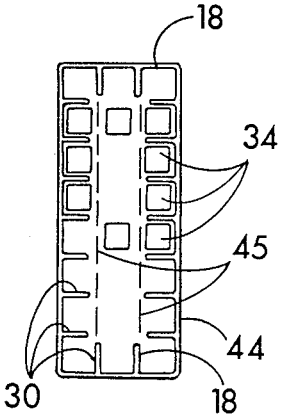
FIG. 6 is a cross-sectional view of laminates formed into a package in accordance with another embodiment of the invention.
Figure 7:
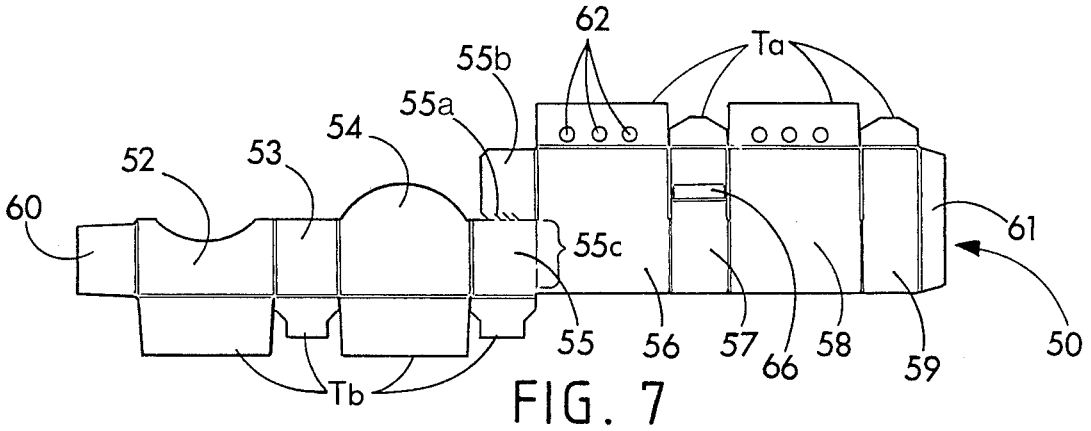
FIG. 7 shows a plan view of one form of carton blank that can be employed with the invention.

Refer now to FIG. 6 which illustrates another embodiment of the invention. As seen in FIG. 6 the sheet 18 comprises a single sheet lining an entire package 44 so that the necessity of handling separate trays is not necessary. Instead, the laminate 18 is simply bonded to the inside surface of the package 44 which when assembled will then include a plurality of parallel, centrally projecting partitions 30 that form enclosures for the food pieces 34 which are supported loosely inside so that they can be easily removed by sliding out of the ends of the package after it is opened as in FIGS. 1–5. In this case separate trays are not needed. If desired, flat sheets 45 can be inserted into the package 44 on opposite sides of a center row of food pieces, if present, to heat their surfaces.

Figure 8:
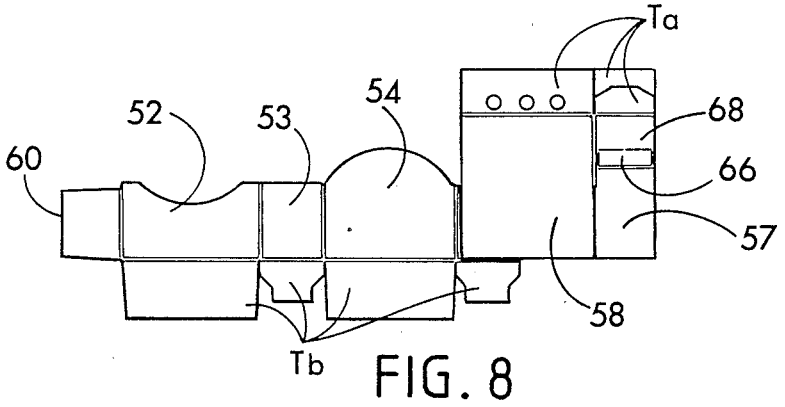
FIGS. 8–10 show successive stages of folding the carton blank into a package while bonding panels together.
Figure 9:
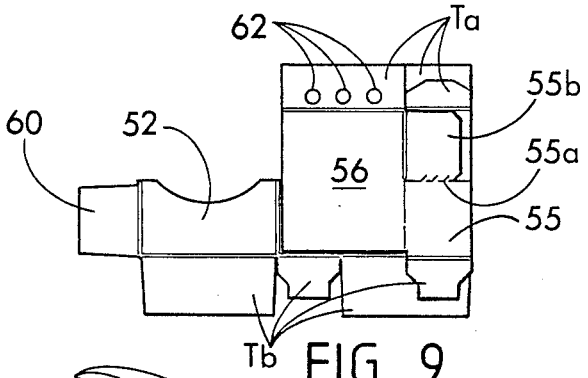
Figure 10:
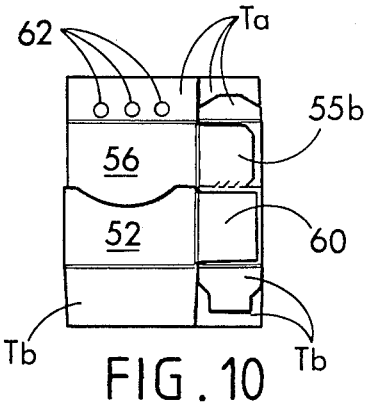
Figure 11:
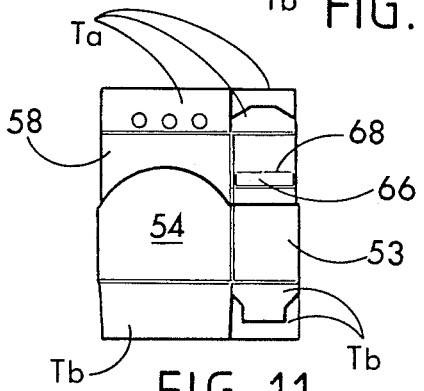
FIG. 11 is a rear view of the flattened carton of FIG. 10.

Refer now to FIGS. 7–10 which illustrate one form of folding carton that can be employed in connection with the invention. As shown in the figures, a flat carton blank 50 formed from food grade paperboard is provided with a plurality of side panels 52–59 to form the side walls of the package. Tabs Ta form the top and tabs Tb form bottom walls, and tab 60 is bonded to panel 55 and tab 61 is bonded by adhesive to side panel 56 to hold the package together as shown in FIGS. 10 and 11. The panels 52–61 and the tabs Ta and Tb are separated from one another by vertical and horizontal fold lines, as shown. A full length panel 55 (located between full length panels 56–59 and half length panels 52–54) is provided with a horizontally extending tear line 55*a* and a cut line 55*c*. The portion below line 55*a* is bonded to panel 60. Panels 52–54 are only a fraction, in this case about one-half, of the height of the package. Some of the top tabs Ta can be provided with steam vent openings 62. To form the package, adhesive is applied to the tabs 60 and 61 and the package is folded in successive stages as shown in FIGS. 8 and 9 from right to left. Finally, from the position shown in FIG. 9, the panels 52 and 60 are folded from the left to right, bonding the tab 60 to the panel 55 as shown in FIG. 10. FIG. 11 illustrates the reverse side of the finished carton.

Figure 4:
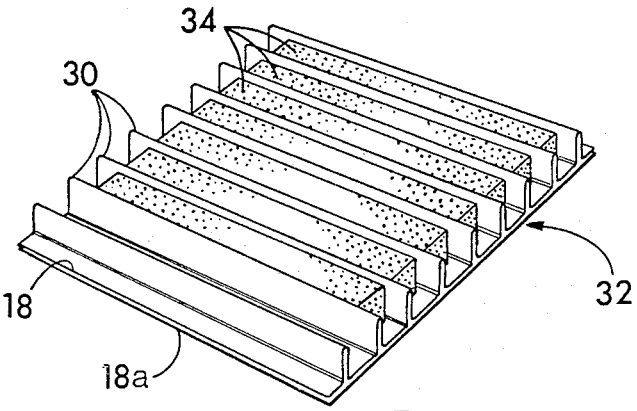
FIG. 4 is a perspective view of one form of laminated tray containing food sticks in accordance with the invention.
Figure 12:
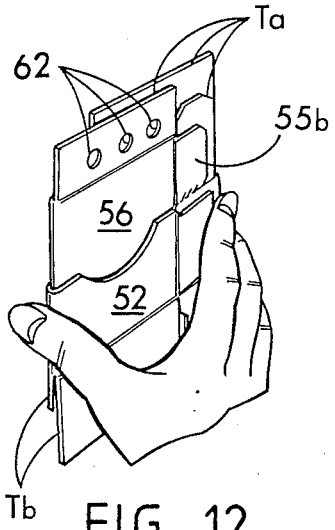
FIGS. 12 and 13 are perspective views showing the opening of the carton prior to filling.
Figure 13:
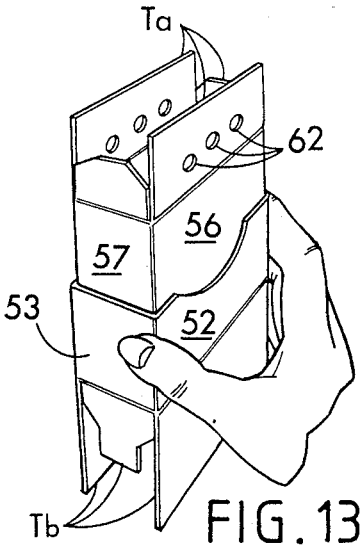
Figure 14:
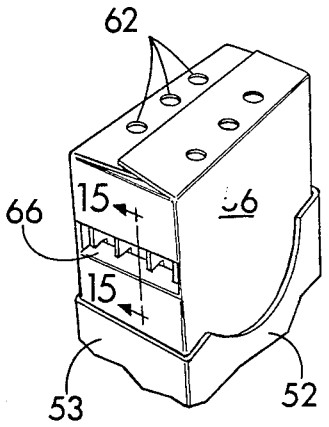
FIG. 14 is a partial perspective view showing the locking tab for holding the trays in place within the carton.
Figure 16:
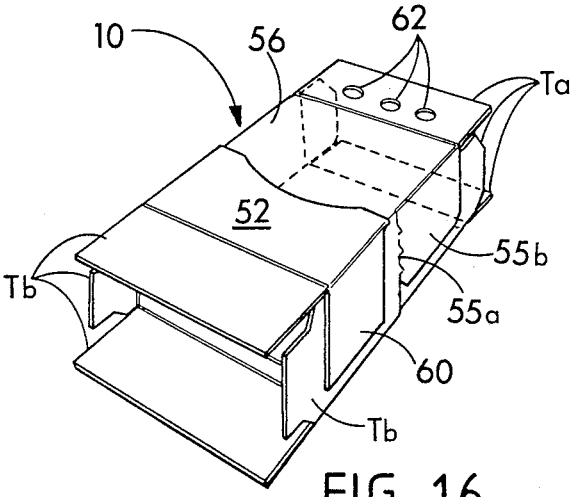
FIG. 16 is a perspective view of the carton prior to filling.
Figure 15:
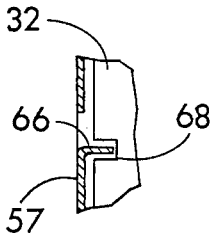
FIG. 15 is a vertical cross-sectional view taken on line 15—15 of FIG. 14.
Figure 17:
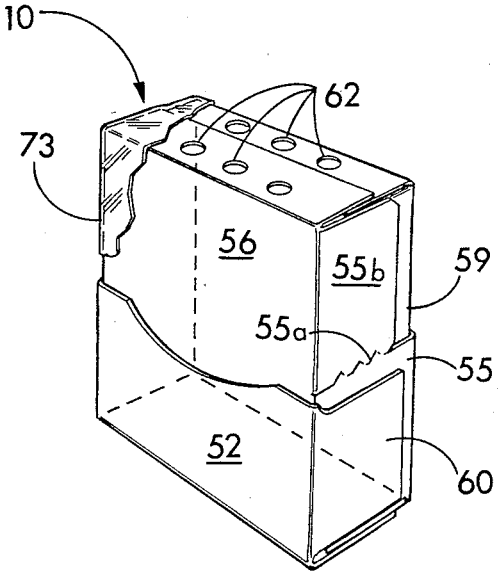
FIG. 17 is a persective view of the filled carton.

When the flattened carton 10 is to be opened, pressure is applied to its edges either mechanically or by hand as shown in FIGS. 12 and 13 to open or set up the carton as shown in FIG. 16. The stack of trays 32 and 32*a* as well as the insulated sheet 18–36 of FIG. 3 is then inserted from either end, either before or after the french fries, fish sticks or other food pieces 34 are placed in the trays 32. In a preferred filling method, the trays 32 are individually filled by placing the food sticks into the compartments between the partitions as shown in FIG. 4 and then assembled by stacking them one on top of the other prior to insertion into the carton 10. The tabs Ta and Tb are then folded down and glued shut as shown in FIG. 17. The carton is overwrapped with protective barrier film 73 such as polypropylene or saran coated cellophane and sealed. The filled carton is now ready for shipment.

While the trays 32 can be held in place in the carton in a variety of ways, one satisfactory method is to provide a small tab 66 in one of the side walls, preferably the side wall 57. The tab 66 is folded inwardly so as to project into suitable slots 68 in the edges of the trays 32. In this way the trays 32 will be held in place within the carton even after the carton is opened. Alternatively, the trays can be held in place by friction or by means of adhesive or the like.

The carton 10 thus comprises inner and outer telescoping portions 70 and 72, held together by tear line 55*a*, the upper portion 70 having a height which is the same as the carton 10. The lower portion 72 has a height which is, in the carton shown, about one-half the height of the carton.

Figure 18:
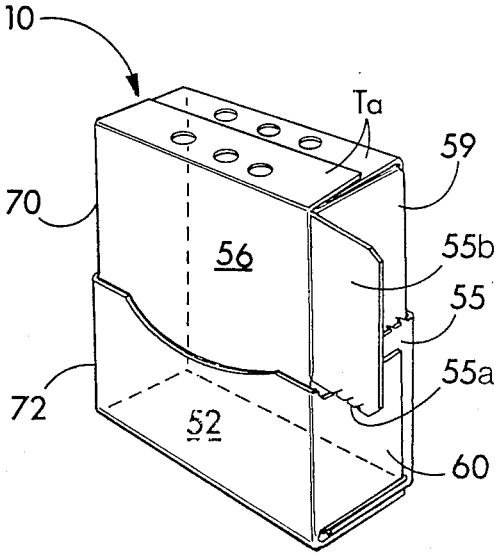
FIG. 18 is a perspective view similar to FIG. 17 with the opening tab torn open.
Figure 19:
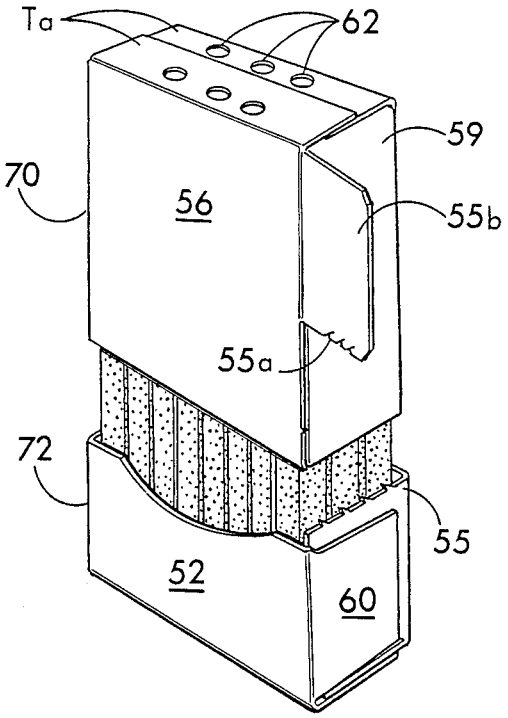
FIG. 19 is a perspective view of the package with the top portion partially removed.
Figure 21:
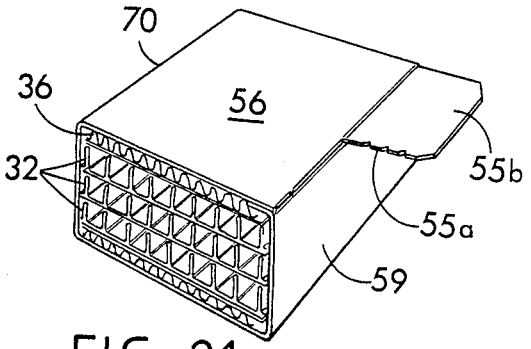
FIG. 21 is a perspective view of the top portion of the package after being removed.

When the carton is to be opened, the upper portion 55*b* is pulled out thereby tearing the panel 55 along the tear line 55*a* as shown in FIG. 18. This allows the entire upper portion 70 of the carton to be separated and raised as shown in FIG. 19 to expose the food sticks 34 that remain in the lower portion 72 of the carton which then functions as a serving tray. The upper portion 70 as shown in FIG. 21 holds the trays 32 and the insulated sheet 36. It can therefore be seen that the lifting of the upper portion 70 of the carton separates the carton and the microwave interactive heating laminates 32 from the food product 34 which remains in place, i.e., slides end-wise out of the compartments in the trays 32 and remains in the lower portion 72 of the carton where they can then either be eaten directly or placed in a serving bowl or dish.

It should be noted that the compartments for the rectangular food sticks 34 in the trays 32 have a square bottom rather than a round bottom as in corrugated board or other corrugated partitioning packages. In this way the food product 34 is surrounded on three sides by the microwave interactive material of the tray 32 in which it rests and on the fourth side by the sheet 18*a* of the sheet above it so that there is a uniform clearance on all major surfaces of the food piece. The food pieces are slidably and removably held in their compartments. The clearance typically is about 1/64 to 1/32 inches. During heating in the microwave oven, the partitions 30 will pick up microwave energy and transmit it in the form of heat directly to the surfaces of the food pieces which in the course of heating will be crisped as they are toasted. The holes 62 allow the escape of excess steam. In this way the food pieces 34 are toasted, browned and crisped uniformly on all four sides.

The carton 10 is constructed as can be seen so that it can be assembled on a standard end-load carton machine as a one-piece folding carton. It is only after the tab 55*b* is pulled causing panel 55 to separate along tear line 55*a* that the top of the carton 70 can be separated from the bottom portion 72 to form a two piece telescoping carton.

Figure 22:
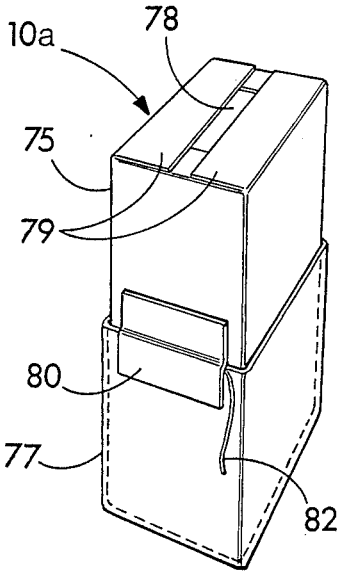
FIG. 22 is a modified form of the invention.

Refer now to FIG. 22 which illustrate a modified form of the invention. The carton 10*a* in this case includes upper and lower telescoping sections 75 and 77 each of which consists of a five-sided carton open at one end and unlike FIGS. 7–11 being unconnected mechanically. The upper and lower portions 75 and 77 can be formed in any convenient way known to the art, preferably with an opening 78 between the end flaps 79 to provide a steam vent. The upper and lower portions of the carton 75 and 77 are in this case held together by means of a tear tape 80 which can be severed by means of by pulling on tear string 82. Once the tear tape has been severed, the upper portion 75 can be lifted from the lower portion 77 to expose the food sticks 34 as in the previous embodiments. The use of the tear tape 80 allows the carton 10*a* to be formed from two separate upper and lower portions rather than from a single piece as shown in FIGS. 7–11. A single piece carton as shown in FIGS. 7–11 is however preferred because fabrication is simplified and the folding operation illustrated will form a carton of two pieces with upper and lower portions slidably related.

While the invention is suited for a variety of different kinds of food pieces, it is particularly well suited for use with fabricated food products such as fabricated french fried potatoes prepared from a moist, cooked and mashed potato mass, i.e. potato dough which is molded to rectangular shape shown, cut into pieces of the required length, fried in hot shortenening and then placed in the package.

Figure 23:
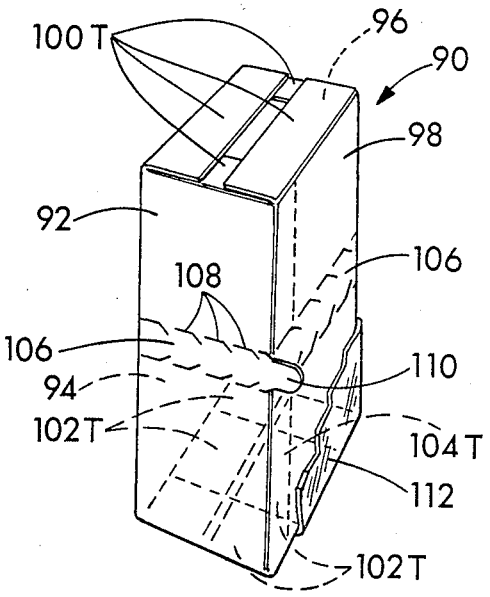
FIG. 23 is a perspective view of another form of the invention.

Refer now to FIG. 23 which shows another modified form of the invention. The carton 90 of FIG. 23 has been simplified in construction so that it consists of four side walls 92, 94, 96 and 98 intersecting at right angles and connected by fold lines. Extending toward the right from the right end of panel 92 is a tab 104T which underlies one edge of the panel 98 and is bonded thereto by a suitable adhesive. This holds the carton 90 together at the edges of the carton blank. Four tabs 100T extend upwardly from the top of panels 92–98 and are bonded together to close the top of the carton. Similarly four bottom tabs 102T extend from the bottom edges of the side walls and are connected to them by means of fold lines. When the carton is erected and filled the tabs 100T and 102T are glued in place as shown to seal the ends of the carton. From this description it will be understood that upper and lower portions of the carton are not telescopically related.

Extending circumferentially around the entire carton 90 is a removable tear strip 106 which consists simply of adjacent serrations 108 that extend around the carton in two parallel rows. At one end of the tear tape 106 is a pull tab 110 enabling the user to grasp the tear tape and by pulling on the end to sever the tape 106 along the top and bottom edges entirely around the carton 90 to remove the entire tear tape 106 thereby separating the carton 90 into upper and lower portions above and below the former location of the tear tape. The top portion of the carton 90 above the tear tape 106 can then be removed. Like the embodiments described above the upper portion of the carton 90 above tear tape 106 is provided with a plurality of food product heating chambers held therewithin. The chambers will appear similar to those illustrated in FIG. 21 within the trays 32 after the top portion of the carton 90 has been removed. Since the food heating chambers and trays of the carton 90 located above the separation line 106 are the same as those already described herein in connection with FIGS. 1–21, the description will not be repeated. The heating compartments can be suitably held within the portion of the carton 90 above the tear tape 106 in any convenient way as by means of an adhesive or a locking tab already described. For most food products it is preferred that a transparent overwrapping barrier 112 such as a lightweight sheet of transparent plastic, cellophane or other suitable sheet material be applied to the outside of the carton 90 to help preserve the food product therein.

Figure 20:
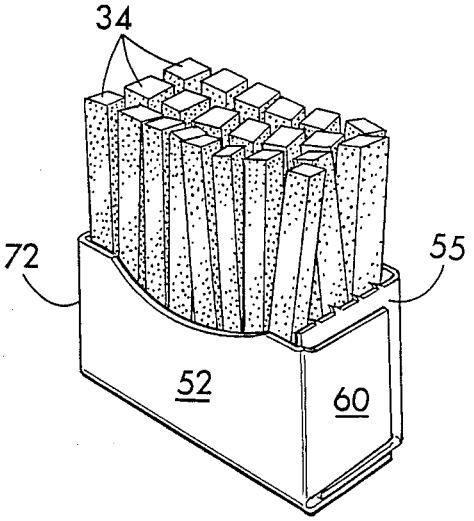
FIG. 20 is a view of the bottom portion of the package functioning as a serving tray with the food product therein.

When the carton 90 is to be used it is placed in the microwave oven until the food product is warmed and the surfaces are toasted to a crispy brown. The package is then taken from the oven and the tab 110 is pulled around the periphery of the carton so as to completely remove the tear strip 106. The portion above strip 106 is then lifted, at which time the food product contained in the package slides out of the compartments between the microwave reactive heating sheet material and then rests within the portion of the package below the tear line 106, generally in the same manner as shown in FIG. 20.

Many variations of the present invention within the scope of the appended claims will be apparent to those skilled in the art once the principles described above are understood.

What is claimed is:

1. A microwave heating package including an outer microwave transparent packaging enclosure, food pieces contained therein and an inner microwave receptive heating sheet for heating the food pieces, said sheet being located within the package and contained within the enclosure, said sheet comprising a backing and a microwave receptive heating material associated therewith, said sheet being formed into a plurality of longitudinally extending, laterally spaced apart heat emitting partitions separating food pieces and defining a honeycomb-like array comprising a plurality of food compartments, each of said compartments enclosing said food pieces on more than two sides of each piece with the microwave receptive sheet to heat adjacent surfaces of each food piece so as to toast, brown or crisp them when exposed to microwave energy within a microwave oven by transfer of heat from the microwave receptive sheet to the surfaces of the food pieces.

2. The package of claim 1 wherein the sheet comprises a tray made from said sheet by being formed into a plurality of parallel upright folded flutes defining the partitions, said partitions comprising folded sheet material, said partitions extending parallel to one another and each partition comprising a double thickness of said sheet to provide a fluted tray in which the longitudinally extending partitions enclose food pieces deposited in each of said compartments on three sides thereof.

3. The package of claim 1 wherein the food pieces are elongated, at least one additional piece of said sheet material is provided in said package proximate to said sheet to enclose each of said food pieces along its length on all major surfaces to thereby transmit heat directly to adjacent surface of the food piece by conduction from the heated sheet during exposure to microwave energy in a microwave heating oven.

4. The package of claim 1 wherein the sheet comprises a paper sheet laminated to each side of the base sheet coated with a microwave receptive heating layer and said laminate is folded into a plurality of parallel flutes defining said partitions, each flute comprising a bonded double thickness of said laminate.

5. The package of claim 1 wherein the sheet comprises a first set of spaced apart parallel sheets and a second set of parallel spaced apart sheets, said second set being oriented at right angles to the first set and being interlocked therewith to define a plurality of chambers therebetween containing said pieces of food.

6. The package of claim 1 wherein the food pieces are formed from a cooked potato mash comprising a formable potato dough, said dough is formed into strips, fried, and thereafter placed into said package.

7. The package of claim 6 wherein the potato product is formed from fabricated potato pieces composed of cooked moldable moisture-containing potato mash, said mash is formed into self-supporting dough pieces, said pieces are cut to a selected length and are fried in shortening, and the fried pieces are placed in said package.

8. The microwave heating package of claim 2 wherein the compartments of said tray define chambers which conform to the shape of the food product contained in each such chamber.

9. The microwave heating package of claim 2 wherein each of the compartments has a flat bottom wall and the partitions intersect the bottom wall at right angles and the right angle intersection between the partitions and the bottom wall conforms to the shape of said food product and said food product has a rectangular cross-section.

10. The microwave heating package of claim 1 wherein said heating sheet is held in the package so as to be retained therein after the package is opened and the food is removed.

11. A microwave heating package for food sticks comprising an outer package that is transparent to microwave energy and a partitioned microwave heating tray therein having flutes that do not touch each other formed from microwave receptive sheet material wherein said flutes define a plurality of side walls, said walls are joined by flat intersecting bottom walls to thereby provide a three-sided enclosure to crisp, brown or toast adjacent surfaces of each food stick placed on the flat bottom wall between the flutes.

12. The microwave heating package of claim 11 wherein a plurality of parallel undulations in said tray are provided and said undulations are folded to form said flutes, said undulations are bonded together and said flutes define partitions extending between adjacent food pieces, said partitions comprising said side walls.

* * * * *